US007703865B2

(12) United States Patent
Knöller

(10) Patent No.: US 7,703,865 B2
(45) Date of Patent: Apr. 27, 2010

(54) STORAGE COMPARTMENT FOR A REFRIGERATION DEVICE

(75) Inventor: Thomas Knöller, Karlsruhe (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/567,528

(22) PCT Filed: Aug. 27, 2004

(86) PCT No.: PCT/EP2004/009581

§ 371 (c)(1),
(2), (4) Date: Feb. 7, 2006

(87) PCT Pub. No.: WO2005/024320

PCT Pub. Date: Mar. 17, 2005

(65) Prior Publication Data

US 2006/0198985 A1 Sep. 7, 2006

(30) Foreign Application Priority Data

Aug. 29, 2003 (DE) ..... 103 39 936

(51) Int. Cl.
*A47B 96/04* (2006.01)

(52) U.S. Cl. ..... 312/405.1; 312/408; 312/321.5

(58) Field of Classification Search ..... 312/408, 312/410, 405.1, 321.5; 108/106–108, 110, 108/144.11, 147.11, 147.17, 152; 211/90.02, 211/103, 119.003, 187, 193, 208
See application file for complete search history.

(56) References Cited

U.S. PATENT DOCUMENTS

| | | | | | |
|---|---|---|---|---|---|
| 2,386,150 | A | | 10/1945 | Swedman | |
| 4,735,470 | A | | 4/1988 | Falk | |
| 4,829,653 | A | | 5/1989 | Stich | |
| 4,944,566 | A | * | 7/1990 | Carper | 312/311 |
| 5,226,707 | A | * | 7/1993 | Han et al. | 312/408 |
| 5,641,217 | A | * | 6/1997 | Caruso et al. | 312/408 |
| 5,677,030 | A | * | 10/1997 | Shanok et al. | 108/27 |
| 5,813,741 | A | * | 9/1998 | Fish et al. | 312/408 |
| 6,565,169 | B1 | * | 5/2003 | Moreno-Olguin et al. | 312/404 |

FOREIGN PATENT DOCUMENTS

| | | | | |
|---|---|---|---|---|
| DE | 196 33 975 | | 2/1998 | |
| FR | 2671950 | * | 7/1992 | 312/408 |

OTHER PUBLICATIONS

International Search Report PCT/EP2004/009581.

* cited by examiner

*Primary Examiner*—Hanh V Tran
(74) *Attorney, Agent, or Firm*—James E. Howard; Andre Pallapies

(57) ABSTRACT

A storage compartment for a refrigeration device, including a frame that having at least two elongated arms lying at a distance from one another forming an intermediate space therebetween. A holder for the refrigerated products, configured to rest on the arms and to lock into the intermediate space lying between the arms.

20 Claims, 3 Drawing Sheets

Fig. 5
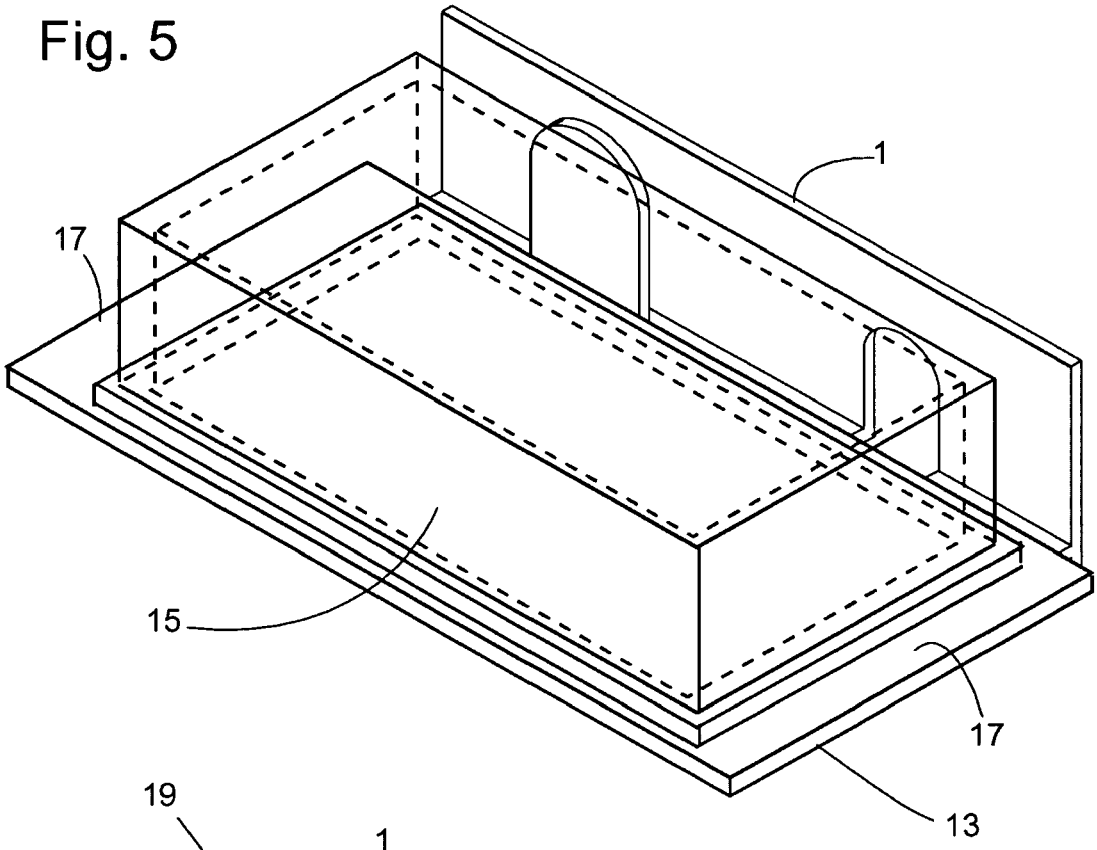
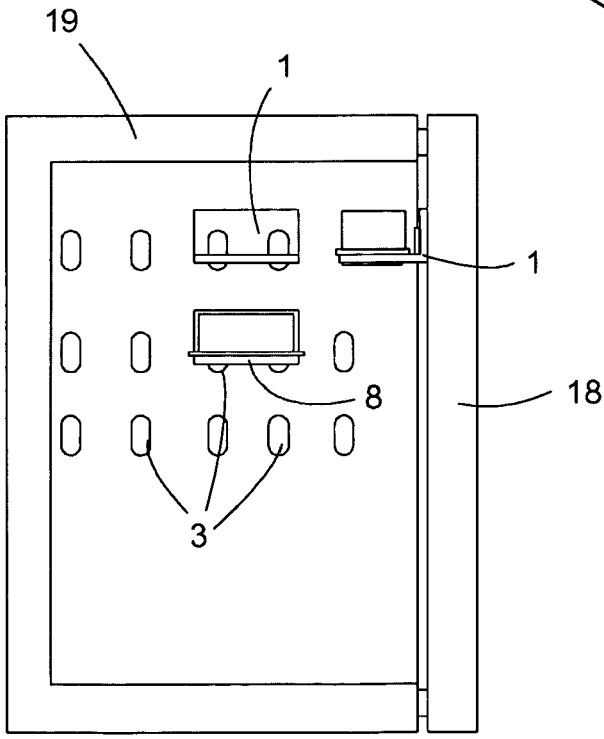
Fig. 6

STORAGE COMPARTMENT FOR A REFRIGERATION DEVICE

The present invention relates to a storage compartment which can be mounted in a refrigeration device to store refrigerated products therein. Storage devices of this type can be mounted on the body of a refrigeration device; then they mostly have the form of plates suspended on opposing walls of an interior compartment of the refrigeration device and largely fill the free base area of the interior compartment. Storage devices for mounting on an inside of the door of a refrigeration device mostly have the form of boxes open at the top which can be mounted with the aid of locating means on the box and the inside of the door which are adapted to one another, at selectable heights on the inside of the door. Storage devices in the form of boxes which can be mounted on the inside of the door and have a pivotable flap are also in common use.

Many of these storage device are dismountable so that they can be mounted at different heights in a refrigeration device as required by the user but the mounting and dismounting process is usually difficult so that it is not appropriate for a user to completely remove such a storage device when he would like to access refrigerated goods stored therein or thereon.

It is the object of the invention to provide a storage compartment which is at least partly removable from the refrigeration device in order to access its contents and which then can be placed quickly and conveniently back in the refrigeration device.

The object is solved by a storage compartment for a refrigeration device, comprising a frame that consists of at least two elongated arms located at a fixed distance from one another and a holder for the refrigerated products which is configured to rest on the arms and to engage in a locating manner into an intermediate space between the arms. The two-part structure allows the frame to be left at its position of installation when the refrigerated-goods holder is removed so that the refrigerated-goods holder can simply be placed back on the arms again and located therein when it is no longer required outside the refrigeration device. This locating in the intermediate space between the arms secures the refrigerated-goods holder against slippage and falling out which is especially important when the frame is mounted on the door of the refrigeration device.

The two arms are preferably constructed as contiguous and in one piece so that the fixed distance between them is defined by this relationship.

The frame preferably surrounds the intermediate space, that is the arms are interconnected at their two ends. A high degree of stiffness and stability of the frame is thus achieved.

For the handling of the refrigerated-goods holder, however it can also be appropriate if the two arms each have one end connected to a common anchoring portion and one free end.

The refrigerated-goods holder can be a container whose walls enclose an interior space but it can also be constructed as substantially plate-shaped without an enclosed interior space.

If the refrigerated-goods holder is a container, from the point of view of the stability it is desirable if its interior extends below the arms so that the centre of gravity of the refrigerated-goods holder and optionally its contents come to lie as low as possible. In such a case, it is the container itself which is located between the arms.

A cover can be allocated to the container.

If the refrigerated-goods holder is a supporting plate resting on the arms, this is appropriately provided on its underside with at least one projection for locating engagement in the intermediate space to thus ensure secure holding on the arms. A cover can be allocated to the supporting plate, in this case the cover should be constructed as container-shaped with an interior compartment.

It is especially preferable if this container-like cover itself can be inserted as a refrigerated-goods holder in the frame alternatively to the supporting plate.

In this arrangement, the conventional supporting plate can take over the function of the cover, in other words the supporting plate and its cover can be placed in two different configurations in the frame, once with the supporting plate at the bottom and on the other occasion with the cover at the bottom.

The arms of the storage compartment are mounted on an inner side of a door of a refrigeration device, optionally by means of the anchoring portion. However, it would be equally possible to attach the device on an inner wall of the body of a refrigeration device.

Further features and advantages of the invention are obtained from the following description of exemplary embodiments with reference to the appended figures. In the figures:

FIG. 5 is a view of the storage compartment from FIG. 3, where the container-like refrigerated-goods holder is placed on the plate-like refrigerated-goods holder as a cover; and FIG. 6 is a schematic section through a refrigeration device which shows different possibilities for attachment of the storage compartment.

Figure 1:
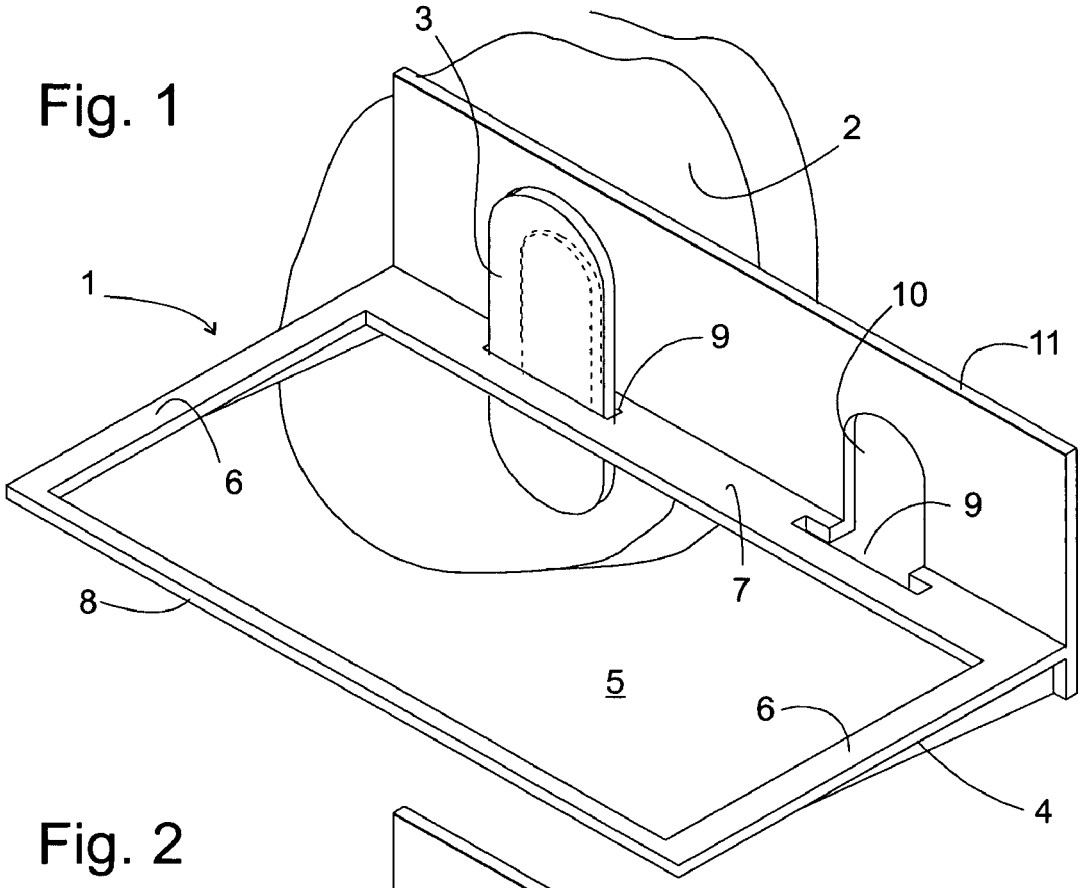
FIG. 1 is a perspective view of a frame of the storage compartment according to a first embodiment of the invention.

FIG. 1 shows a perspective view of the frame 1 of the storage compartment according to the invention and a fragment of a wall 2 of a housing of a refrigeration device in which the frame 1 is mounted. The wall 2 is fitted at regular intervals with fixing spigots 3 which can be lowered, of which one is shown in the retracted state.

The frame 1 has the shape of an L profile comprising a horizontal leg 4 in which a large, in this case rectangular, opening 5 is cut which largely reduces the leg 4 to parallel arms 6 surrounding the opening 5 and a web 7 adjacent to the wall and a web 8 facing away from the wall 8. Two approximately T-shaped recesses 9 are cut into the web 7 near the wall, each forming together with recesses 10 of the vertical leg 11 a receiving opening for one of the fixing spigots 3. The frame 1 is fixedly anchored to the wall 2 by means of two fixing spigots 3 which engage in these receiving openings (of which only one is shown here).

Figure 2:
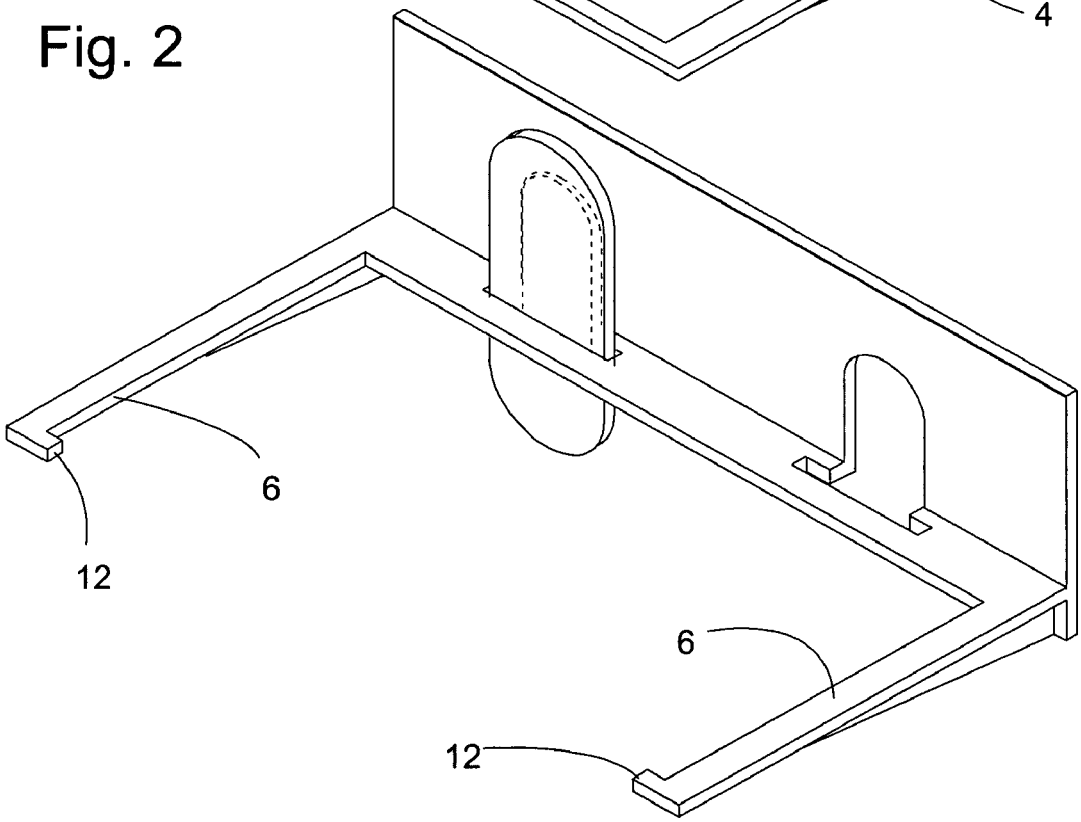
FIG. 2 is a perspective view of a second embodiment of the frame.

In a modification of the frame 1 shown in FIG. 2, the web 8 facing away from the wall 2 is reduced to two fingers 12 directed towards one another which project from the free ends of the arms 6.

Figure 3:
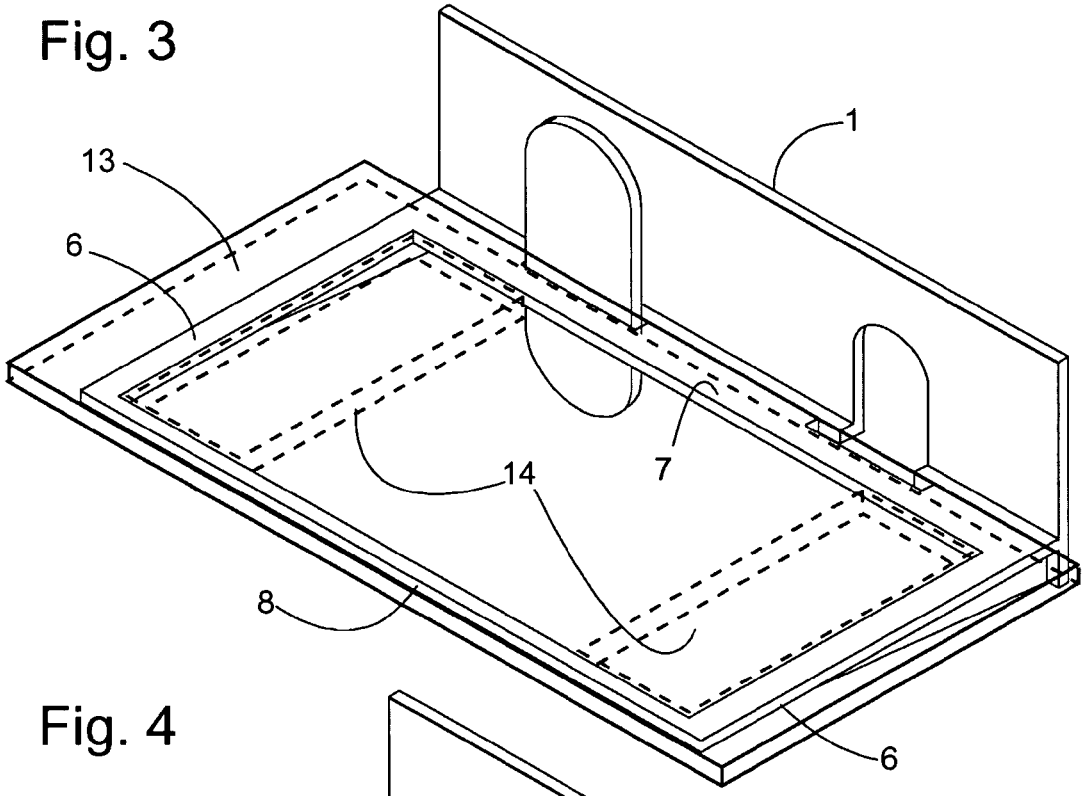
FIG. 3 is the frame from FIG. 1, equipped with a plate-like refrigerated-goods holder.

FIG. 3 shows the frame 1 from FIG. 1 fitted with a supporting plate 13 which functions as a refrigerated-goods holder, and which rests on the arms 6 and the webs 7, 8 connecting said arms. The supporting plate 13 is shown as transparent in the figure in order to be able to show two projections 14 which serve as feet for the supporting plate 13 when this is not held in the frame 1 but for example is placed on a worktop. The projections 14 are dimensioned and placed so that they hold the supporting plate 13 non-displaceably in the horizontal direction as a result of their engagement between the arms 6 and the webs 7, 8.

For simplicity the supporting plate 13 is shown in the figure with a flat upper side; however, it can be arched for example or have locating projections or webs which hold a cover placed on the supporting plate 13 (not shown in the figure) so that it cannot be displaced in the horizontal direction.

Figure 4:
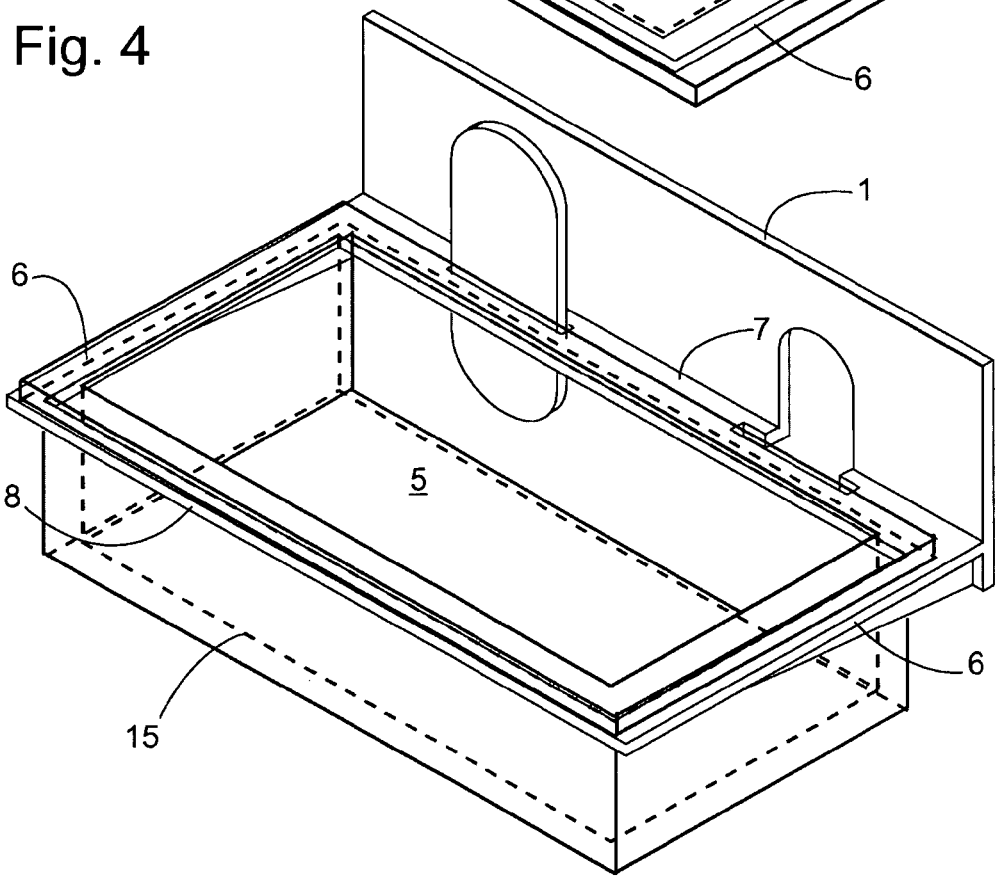
FIG. 4 is the frame from FIG. 1, equipped with a container-like refrigerated-goods holder.

FIG. 4 shows the frame 1 from FIG. 1 equipped with a refrigerated-goods holder in the form of a box 15 comprising a base and four side walls. A circumferential flange 16 at the upper edge of the side walls rests on the arm 6 and the webs 7, 8; the box 15 itself has its dimensions adapted to the spacing of the arms 6 so that it engages in the opening 5 in a located fashion and cannot be displaced horizontally.

FIG. 5 shows the same box 15 as in FIG. 5 but this time in a turned orientation in which it serves as a cover for the supporting plate 13 from FIG. 3. The supporting plate 13 and the box 15 can thus be used jointly for example as a butter dish which can easily be removed together with the contents from the frame 1 mounted in the refrigerator and placed on a dining table and can then be replaced in its locating position on the frame 1 after use.

In order to remove this butter dish, a user must grip the supporting plate 13 at it tabs 17 which project laterally over the arms 6 and the box 15. If the tabs 17 are sufficiently large, it can be sufficient to grip only a single one thereof; if the tabs 17 are too short to allow a secure grip, the butter dish must be handled with both hands. The frame 1 from FIG. 2 also allows the supporting plate 13 to be gripped with the thumbs from below and the box 15 to be gripped with the other fingers of a hand from above regardless of the size of the tabs 17. This configuration of the frame thus allows the tabs 17 to be kept short and so save space in the refrigerating device.

FIG. 6 shows various possibilities for attaching the storage compartment according to the invention by means of a schematic section through a refrigeration device. Although the typical use is the attachment to fixing spigots 3 of a door 18 of the refrigeration device, it is also possible to mount it on an inner wall of the body 19 if this is appropriately provided with the fixing spigots 3.

The invention claimed is:

1. A storage compartment of a refrigeration device, comprising:

a frame including at least two elongated arms located at a fixed distance from one another forming an intermediate space therebetween, said arms each having one end connected to a common anchoring portion that is mounted to an inner side of a door of the refrigeration device in an installed position of the storage compartment in the refrigeration device; and a removable holder for refrigerated products configured to rest on said arms, said holder engaging in a locating manner into said intermediate space, wherein the common anchoring portion of the frame includes a support leg from which the arms extend and a vertical leg connected to an edge of the support leg and extending at an angle relative thereto, and wherein the arms and the vertical leg form an L-profile; said common anchoring portion including at least one generally T-shaped recess, with said recess having a vertical portion formed in said vertical leg and a widened slot portion formed in said support leg.

2. The storage compartment according to claim 1, wherein said two arms are constructed contiguously and in one piece.

3. The storage compartment according to claim 1, wherein said frame surrounds said intermediate space.

4. The storage compartment according to claim 1, wherein said two arms each have one free end.

5. The storage compartment according to claim 1, wherein said refrigerated products holder is formed as a container having an interior which extends below said arms when said refrigerated products holder rests on said arms.

6. The storage compartment according to claim 5, wherein said container has a cover.

7. The storage compartment according to claim 1, wherein said refrigerated products holder is formed as a supporting plate resting on said arms, said supporting plate provided on its underside with at least one projection for locating engagement into said intermediate space.

8. The storage compartment according to claim 7, further comprising a container-like cover allocated to said supporting plate.

9. The storage compartment according to claim 8, wherein said container-like cover can be inserted as a refrigerated-goods holder in said frame.

10. The storage compartment according to claim 1, wherein said refrigerated products holder is formed as a supporting plate resting on said arms, wherein the supporting plate includes two projections on an underside of the supporting plate, the two projections for supporting the supporting plate when the supporting plate is removed from the arms, and for engaging between the arms and holding the supporting plate non-displaceably in a horizontal direction when the supporting plate is resting on the arms.

11. A refrigeration device, comprising:

a body having an interior refrigerating compartment;

said compartment including at least one wall and at least two fixing spigots mounted thereon, each of said fixing spigots have a generally T-shaped cross section with a stem portion and a topping portion perpendicular to said stem portion and forming a top of the T;

a storage compartment mountable on said fixing spigots;

said storage compartment including a frame having at least two elongated arms located at a fixed distance from one another forming an intermediate space therebetween, said arms each having one end connected to a common anchoring portion configured to mount on the fixing spigots, said common anchoring portion of said frame including a support leg from which said arms extend and a vertical leg connected to an edge of said support leg and extending at an angle relative thereto, and said common anchoring portion of said frame including a pair of generally T-shaped recesses, each of said generally T-shaped recesses receiving a respective one of said fixing spigots with each of said generally T-shaped recesses having a vertical portion formed in said vertical leg and a widened slot portion formed in said support leg, each of said generally T-shaped recesses receiving a respective one of said fixing spigots in a manner in which said topping portion of the respective fixing spigot extends through said widened slot portion of said generally T-shaped recess at a spacing from said vertical leg; and a holder for refrigerated products configured to rest on said arms, said holder engaging in a locating manner into said intermediate space.

12. The refrigeration device according to claim 11, wherein said two arms are constructed contiguously and in one piece.

13. The refrigeration device according to claim 11, wherein said frame surrounds said intermediate space.

14. The refrigeration device according to claim 11, wherein said two arms each have one free end.

15. The refrigeration device according to claim 11, wherein said refrigerated products holder is formed as a container having an interior which extends below said arms when said refrigerated products holder rests on said arms.

16. The refrigeration device according to claim 15, wherein said container has a cover.

17. The refrigeration device according to claim 11, wherein said refrigerated products holder is formed as a supporting plate resting on said arms, said supporting plate provided on its underside with at least one projection for locating engagement into said intermediate space.

18. The refrigeration device according to claim 17, further comprising a container-like cover allocated to said supporting plate.

19. The refrigeration device according to claim 18, wherein said container-like cover can be inserted as a refrigerated-goods holder in said frame.

20. The refrigeration device according to claim 11, wherein said compartment wall is a door and said arms mounted on an inner side of said door.

* * * * *